United States Patent [19]

Alefeld

[11] 4,314,448

[45] Feb. 9, 1982

[54] THERMODYNAMIC PROCESS FOR EXPLOITING HIGH-TEMPERATURE THERMAL ENERGY

[76] Inventor: Georg Alefeld, Josef-Raps-Strasse 3, 8000 Münich 40, Fed. Rep. of Germany

[21] Appl. No.: 933,578

[22] Filed: Aug. 14, 1978

[30] Foreign Application Priority Data

Aug. 17, 1977 [DE] Fed. Rep. of Germany ..... 2737059

[51] Int. Cl.[3] ..... F01K 21/00; F01K 25/00

[52] U.S. Cl. ..... 60/673; 60/649

[58] Field of Search ..... 60/649, 673

[56] References Cited

U.S. PATENT DOCUMENTS 3,413,801 12/1968 Meijer ..... 60/524 X 4,009,575 3/1977 Hartman et al. ..... 60/673 X

FOREIGN PATENT DOCUMENTS 1389441 4/1975 United Kingdom ..... 60/673

*Primary Examiner*—Allen M. Ostrager

*Attorney, Agent, or Firm*—Scully, Scott, Murphy & Presser

[57] ABSTRACT

Thermodynamic process for exploiting thermal energy available at high temperatures, where a multiple-substance working medium is decomposed in a high temperature range by this high-temperature thermal energy into a condensed (solid or liquid) first component and a gaseous second component and these two components are again united in a low temperature range, releasing effective heat. The multiple-substance working medium contains one of the combinations $CaO/H_2O$ and metal/-hydrogen, where the term "metal" comprises metallic chemical elements and alloys which combine with hydrogen under positive heat of reaction.

20 Claims, 12 Drawing Figures

THERMODYNAMIC PROCESS FOR EXPLOITING HIGH-TEMPERATURE THERMAL ENERGY

Although the chemical energy contained in fossil fuels can generally be converted into work almost entirely, existing power plants (normally operating with gas or steam turbines) obtain efficiencies not greater than 30% to 40%. This applies similarly to thermal power stations obtaining their primary energy from nuclear fuels.

The efficiency of a thermal power station obviously rises with the increase in enthalpy gradient of the working medium in the work-producing cycle, or in practical terms with the rise in temperature at which the thermal energy is introduced into the work-producing cycle. Yet with steam turbine thermal power stations operating on water as a working medium a temperature of about 560° C. constitutes the present upper limit in practical application, considering amongst others that a high temperature is attended by correspondingly high pressures. Another consideration is that the Clausius-Rankine process using $H_2O$ as a working medium, a process normally used by a steam turbine thermal power station, can be carnotised by preheating the feed water (i.e. carried in an essentially reversible cycle which by that token produces the optimum Carnot's efficiency) to about 300° C. only, so that in the steam superheating range between 300° C. and 560° C. considerable irreversibilities reducing the efficiency will occur. The unsatisfactory efficiencies of conventional steam turbine thermal stations are thus due to material, and the main portion of the irreversibility in the cycle of a thermal power station impairing the efficiency is caused by the fact that the high-temperature thermal energy, valuable as it is for the production of work, is brought by irreversible processes to a lower temperature level without doing work, as perhaps from 1500° C. to 560° C. in the superheating section of the power station, or down to 300° C.

There is no lack of publications suggesting the utilization of the high-temperature range for producing work by means of topping cycle. Contemplated for the purpose have been, apart from gas turbine processes, magneto-hydrodynamic processes and the use of thermionic emitters, especially steam processes operating on another working medium, such as the preliminary $H_g$ cycle, the preliminary K cycle, the preliminary diphenyl cycle, and combinations of such steam processes (e.g. see "Brennstoff-Wärme-Kraft", Volume 21, No. 7, pp. 347 to 394, July 1969, and "R.G.T.", No. 99, March 1970, pp. 239 to 269). All these preliminary or topping steam processes, however, require the development of separate turbines which can be driven in the high temperature range with the new working medium.

A publication by Koenemann in "Trans. World Power Conference", Berlin 1930, V.D.I. Publishing House, Volume V, pp. 325 to 336, promulgated the use also of a multiple-medium system for a work-producing prelim. process, where ammoniak is produced under high pressure by evaporization of $NH_3$ from $ZnCl.2NH_3$, is expanded in a turbine to do work, and is subsequently reabsorbed in $Zncl.1NH_3$, where steam is produced with the absorption heat released in the process for use in a subsequent normal steam cycle. The disadvantage inherent in this process is that the use of temperatures substantially higher than about 300° C. is prevented because above this temperature, decomposition of the ammoniak will already be considerable and the steam pressure of the ZnCl will no longer be negligible, so that obstruction of pipes and similar trouble may ensue. Also, this requires a turbine for a second working medium. The advantage provided by the multiple-medium topping process is, however, that the vaporous working medium develops, because of the reduction in vapor pressure, at a lower pressure than in evaporation from the straight liquid or solid phase, which is a benefit especially where high temperatures are used, on account of the alleviated strain on the material.

A publication by Nesselmann in "Zeitschrift für die gesamte Kälte-Industrie" 42, (1935), Journal 1, pp. 8 to 11, also promulgated the principle of non-work-producing multiple-medium topping process in which high-temperature thermal energy can be converted reversibly, i.e. without impairing the efficiency, into thermal energy of a lower temperature falling within a technically exploitable range. Such a "heat transformer" can operate on the principle of an absorption heat pump, and mention is made also of the possibility of working with a solid-gas reaction using a solid and an actual working medium which permits of extraction and read-sorption from and by said solid. The advantage afforded by a solid-gas reaction, namely that a certain pressure is associated with a certain temperature (Gibb's phase rule), are illustrated by way of the $$Ba(OH)_2 \rightleftharpoons BaO + H_2O$$

reaction. As a multiple working medium system this combination of substances is disqualified, however, if only because of its vapor pressure pattern.

A broad aspect of the present invention is to provide processes which can operate with novel multiple-medium systems and can be used, inter alia, for the topping processes of the above-mentioned type in order to reduce the irreversibilities in the Clausius-Rankine process and thus to raise the efficiency of the thermal power station as a whole.

More particularly the present invention provides multiple-medium systems which remain stable also at the high temperatures of special interest, such as temperatures above 400° C. or 600° C. up to temperatures prevailing in the combustion of fossil fuels, and which preferably provide a fluid (gaseous or vaporous) component which can be handled without problem or difficulty, such as $H_2O$ or $H_2$.

It is a particularly object of the present invention to provide a process of the above description characterized by the characterizing portion of Claim 1 or 2.

The further Claims relate to further aspects and advantages of said processes and thermal power stations utilizing said processes.

Further objects and advantages of the present invention will become apparent from the following detailed description read in light of the accompanying drawings, in which FIG. 1 is a simplified temperature-entropy diagram and shows a boiling line I and a dew line II of water ($H_2O$), drawn into which is a Clausius-Rankine process for general illustration of the working mode of a steam turbine thermal power station, where the maximum pressure of the working medium ($H_2O$ steam) is arbitrarily selected at 100 bars; with feed water heating normally practiced in a production power station and similar details here being omitted for clarity of presentation;

Figure 1:
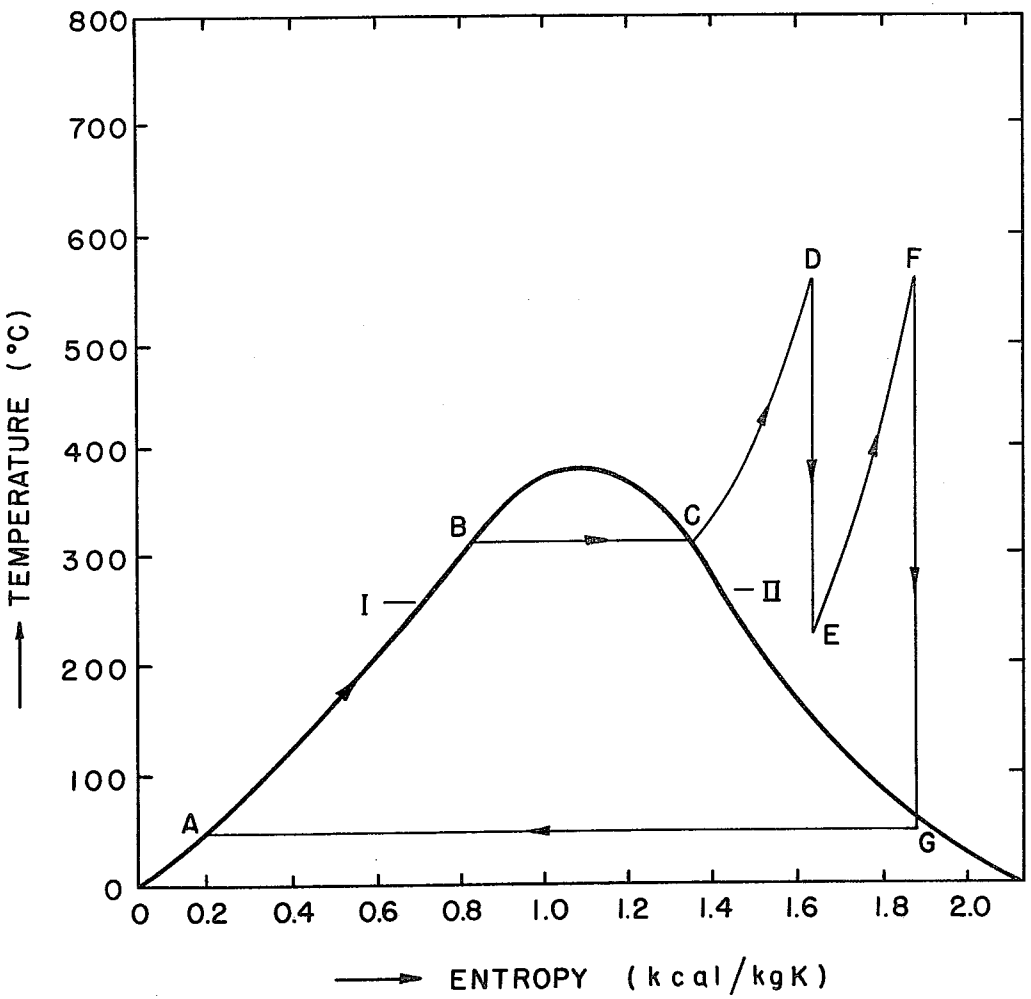
Figure 2:
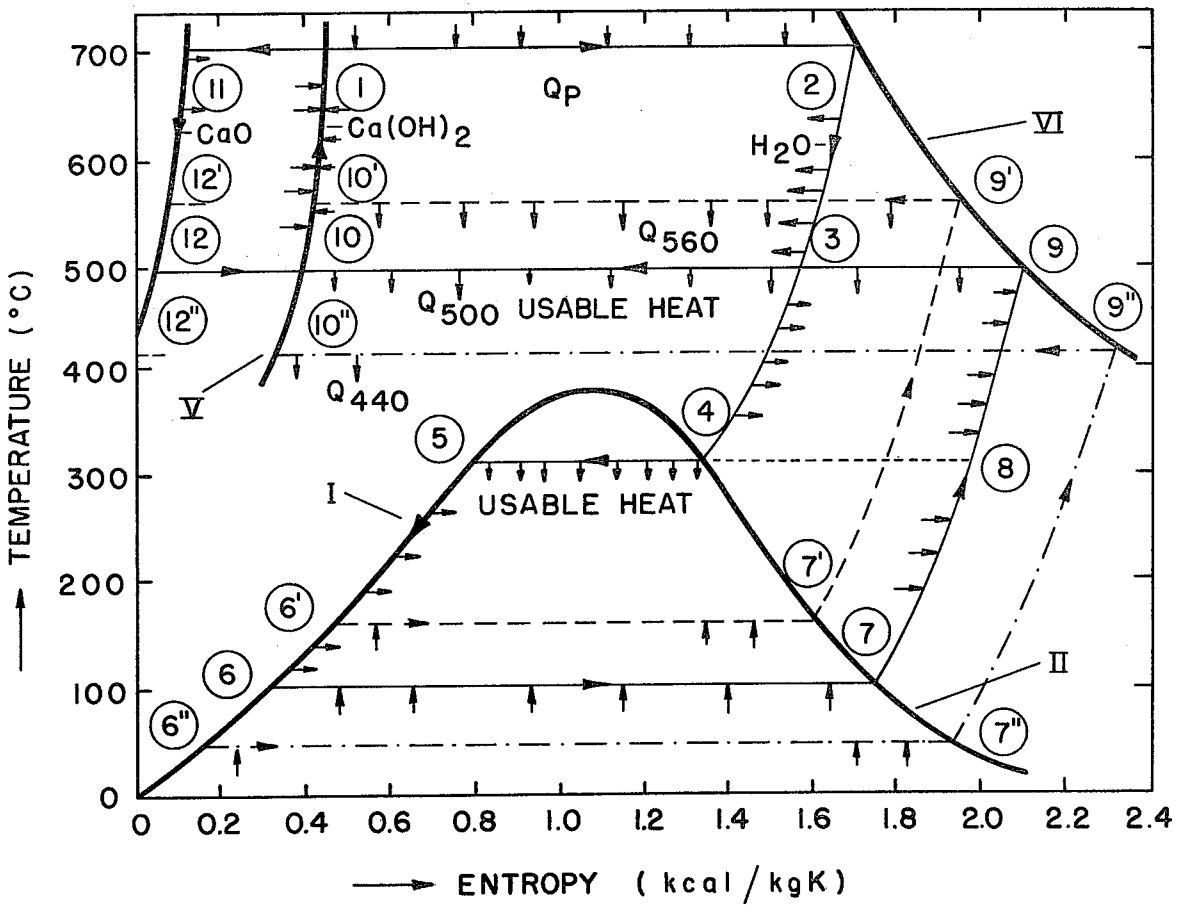
FIG. 2 is a temperature-entropy diagram analogously to FIG. 1 and illustrates an embodiment of the present invention of a topping process not providing any external work and operating on the work medium system illustrated by way of FIG. 3.
Figure 6:
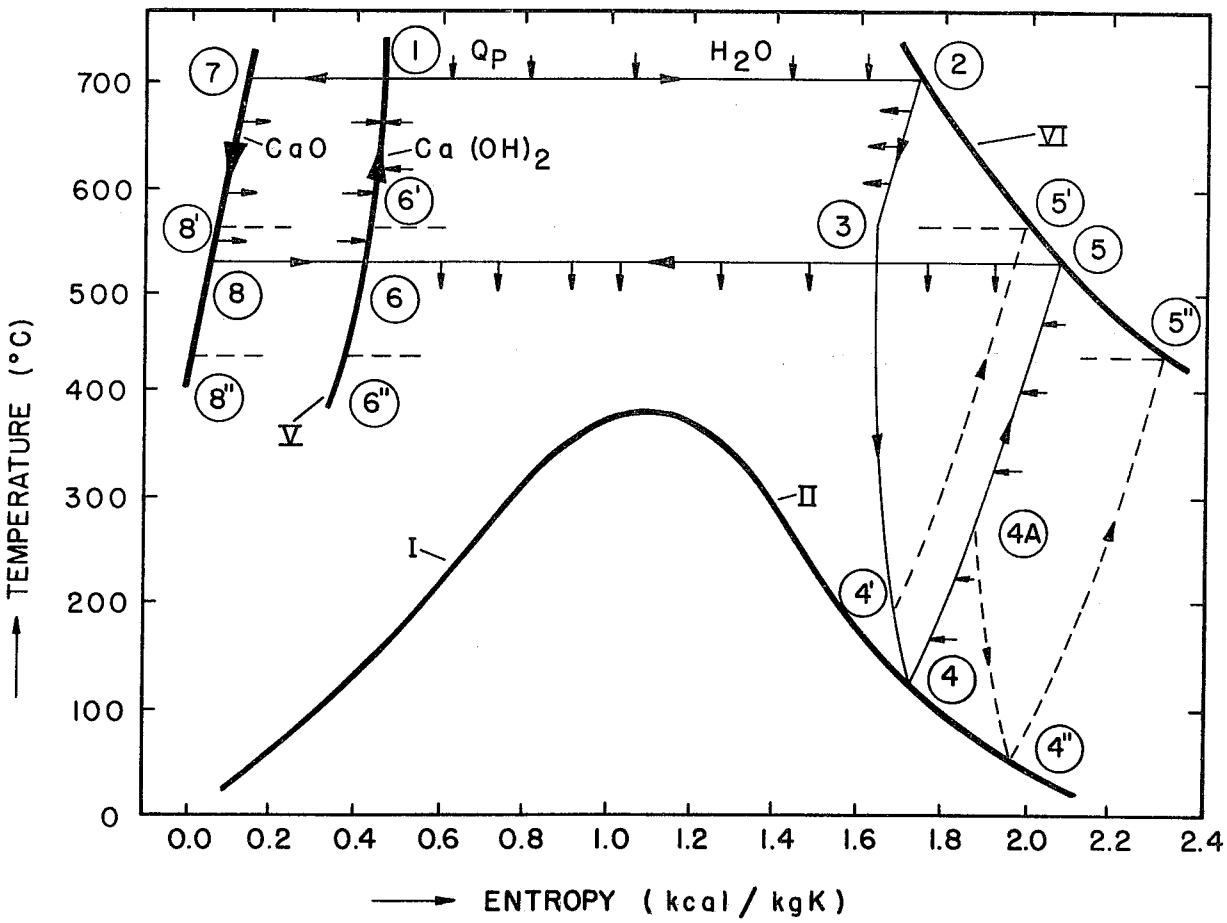
FIG. 6 is a diagram corresponding to FIG. 2 and illustrates a topping process in accordance with an embodiment of the present invention which produces external work and improves the efficiency of a subsequent Clausius-Rankine process.

In the diagrams of FIGS. 1, 2 and 6 the temperature T is plotted in centigrade degrees along the ordinate and the entropy s in kcal/kg °K., and the steam pressure diagram of water is shown.

The stated temperatures reflect the ideal case, with temperature and pressure losses, as perhaps in heat exchangers, being neglected.

FIG. 1 illustrates the working cycle of a Clausius-Rankine process as it is typical of a conventional steam turbine thermal power station using intermediate superheating. The A-B section of the curve reflects the rise of pressure and temperature of the feed water to the pressure and temperature in the steam generator or boiler (e.g. 310° C. and about 100 bars), the C-D section reflects isobar superheating of the steam to a temperature of e.g. 560° C., and the D-E section reflects the expansion of the superheated steam in a first turbine to a temperature of e.g. 220° C. and a pressure of about 10 bars at point E, the E-F section reflects intermediate isobar superheating of the steam to 560° C., the F-G section reflects expansion of the intermediate superheated steam in a second turbine to a temperature of e.g. 20° C. and a pressure of about 0.05 bar, and the G-A section reflects the condensation of the steam in a condenser. Since in a conventional thermal power station the primary energy is available at a temperature substantially higher than the evaporation temperature of about 310° C. or the temperatures in the superheating ranges C-D or E-F, considerable irreversibilities occur to impair the efficiency.

Use of the working medium system of the present invention now permits practical implementation of, e.g., the non-work-producing topping process of the type indicated by Nesselmann (1.c) as illustrated by way of example in FIG. 2 and it permits substantial alleviation of said irreversibilities. With the topping process according to FIG. 2, then, use is made of a multiple-medium system admitted to which can be the primary thermal energy at a substantially higher temperature than with a conventional Clausius-Rankine process of the type generally described by way of FIG. 1 using $H_2O$ as a working medium, without causing excessive pressure levels and without preventing the use of steam as the actual working medium. In the topping process in accordance with FIG. 2 the primary thermal energy is transformed downwards by a reversible process from the original high temperature level to several temperature levels at which thermal energy must be admitted to the Clausius-Rankine process to ensure a high degree of "carnotization".

The topping process in accordance with FIG. 2 is a thermal transformation process in accordance with Nesselmann (1.c) where use is made in accordance with an embodiment of the present invention of a multiple-medium system operating in accordance with the following equation:

$$\underset{\text{(solid)}}{Ca(OH)_2} + Q \rightleftharpoons \underset{\text{(solid) (vaporous)}}{CaO + H_2O}, \qquad (1)$$

where Q indicates the thermal energy to be admitted in the presence of decomposition (arrowhead pointing to R/H side) or released upon union (arrowhead pointing to L/H side). The properties of this multiple-medium system will become apparent from the diagram of FIG. 3, where the left-hand curve III shows the steam pressure upon evaporization from straight $H_2O$ liquid and the right-hand curve IV the steam pressure resulting upon the decomposition of Ca $(OH)_2$ in accordance with equation (1), each as a function of the reciprocal value of absolute temperature.

Figure 3:
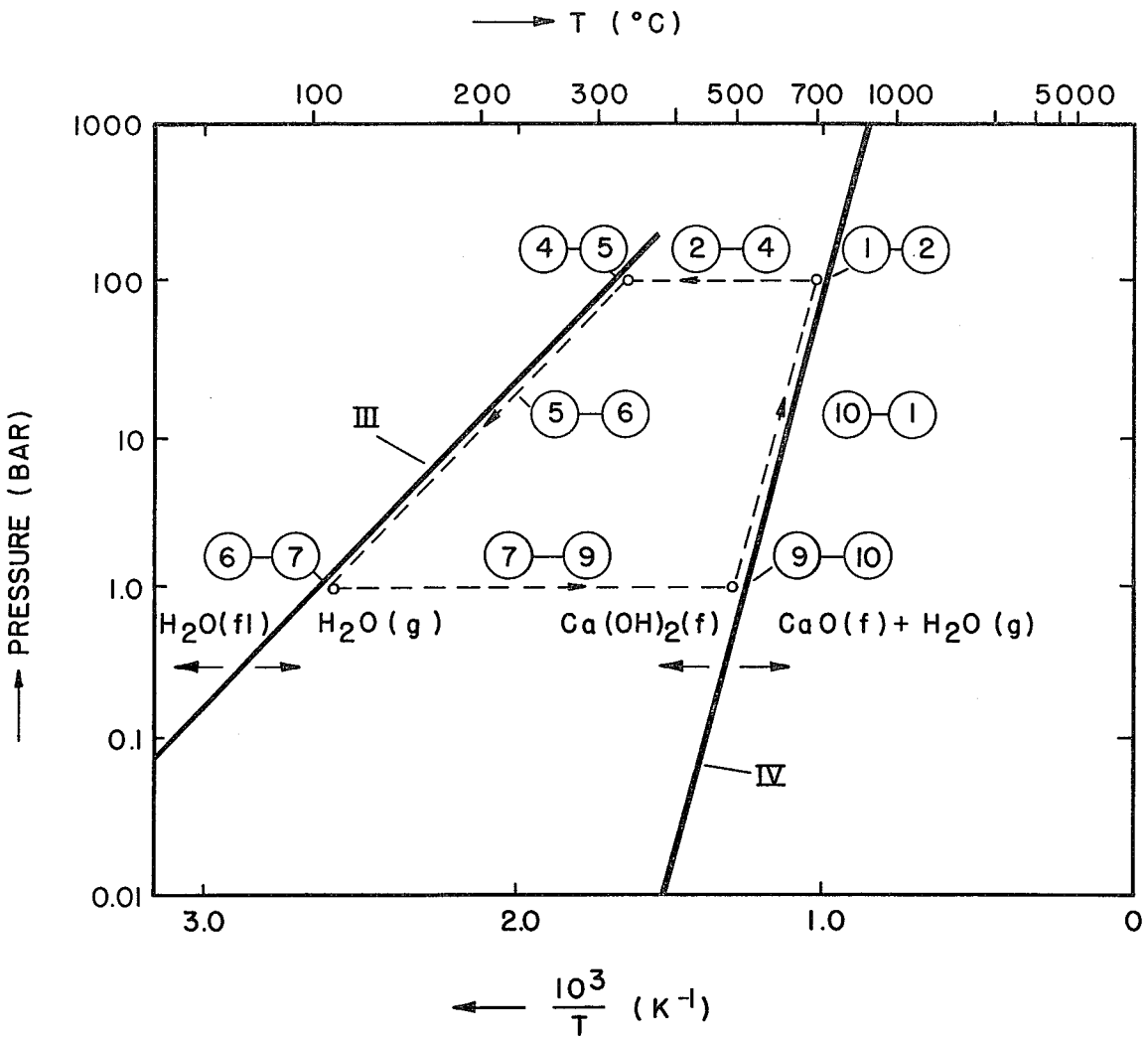
FIG. 3 is a diagram and illustrates an example of a multiple-medium system in accordance with the present invention, where plotted along the ordinate are the natural logarithm of pressure and along the abscissa the reciprocal of absolute temperature, multiplied by the factor of $10^3$.

The temperature-entropy diagram of FIG. 2 is now used to illustrate a thermal transformation process using the multiple-medium system of equation (1), said process being reflected by the solid line in FIG. 2. Various points on the curve in FIG. 2 are indicated by numerals; the corresponding points in the diagram of FIG. 3 are indicated by the same numerals. Plotted also in FIG. 2 are curves V and VI for the working medium system per equation (1) corresponding to the boiling line I or the dew line II of the single $H_2O$ system. Curve VI is identical to curve IV in FIG. 3.

Point 1 of the solid-line curve in FIG. 2 indicates the presence of $CA(OH)_2$. From this compound, steam is expelled at the assumed 700° C. and 100 bars limits by admitting primary thermal energy $Q_p$ from a firing arrangement, a nuclear reactor or the like in the process illustrated by the curve in solid line, where about 5200 kJ per 1 kg steam are required. Expulsion of the steam corresponds to curve section 1-2.

In section 2-3 the steam is cooled in counterflow with CA $(OH)_2$ in accordance with section 10-1 to a temperature of, say, 560° C., and in section 3-4 under heat exchange with the steam in section 8-9 in isobar process to a temperature of 310° C. in counterflow. (The 560° C. here selected by way of example correspond to the maximum turbine inlet temperature frequently practiced in conventional steam power plants).

In section 4-5 the steam is liquefied isothermally, and the heat of condensation released in the process is used for the generation of steam in section B-C in the Clausius-Rankine cycle. (Should the pressures used there be higher, the pressure and with it the temperature of condensation can be raised by raising the expulsion temperature in section 1-2 from 700° C. to 700° C.+Δt.

In section 5-6 the condensed water is cooled in counterflow using the steam in section 7-8 or the feed water in section A-B in the Clausius-Rankine cycle to, e.g., 100° C. and expanded to 1 bar.

In section 6-7 the water is evaporated by the heat of condensation of a partial amount of the partially exhausted steam from the Clausius-Rankine process.

In section 7-8-9 the steam is heated by isobar process to 500° C. The steam is then absorbed in section 9-10 in CaO at 500° C. The heat of adsorption Q 500 released in the process can be used in the Clausius-Rankine process for evaporating water (section B-C) and/or for superheating steam (sections C-D and/or E-F).

The saturated working medium Ca $(OH)_2$ from the absorber in section 10-1 is finally heated to the expulsion temperature of 700° C.

The pressure and temperature data given above and hereinafter are approximate representative figures based on certain literature sources. For the $CaO/H_2O$ system, there exist still other steam pressure data which at a given pressure would permit still higher expulsion temperatures.

With the thermal transformation process described above by way of example, thermal energy of 700° C. is transformed downwards, while additionally admitting thermal energy of 120° C., to 500° C. and 310° C. Transformation can be made virtually fully reversible by means of said internal heat exchange processes, although the amount of thermal energy released in section 5-6 is larger than the amount of thermal energy required in section 7-8, so that the following process approach may be the more advantageous:

The part 3-4-5-6 of the thermal transformation process corresponding to the absorber circuit is carried in counterflow with the part A-B-C-D of the Clausius-Rankine process because the amounts of thermal energy will here fully correspond to one another. The part 7-8-9 of the thermal transformation process per FIG. 2 is carnotized by withdrawal of thermal energy from the Clausius-Rankine process.

The CaO present at point 1 is, in the schematically represented section 11-12, again brought to the conditions corresponding to point 10, so that it will again be available for the absorption of steam. Internal heat exchange will here again serve to prevent appreciable losses. Transportation of the powdery CaO can be achieved in a fluidized bed, i.e., the powdery solid CaO can be fluidized by means of an inert gas, such as helium. This applies equally to powdery Ca $(OH)_2$.

Said $CaO/H_2O$ working medium system provides an advantage in that conditions at absorption are largely known (absorption corresponding to the slaking of quicklime), in that corrosion problems will be few, and ultimately in that the effective working medium is steam, the properties and technology of which are very well known.

Said multiple-medium system can be modified by the addition of other alkaline earth oxides. Such, partial replacement of the calcium with magnesium serves to achieve a given steam pressure at lower temperatures, while partial replacement of the calcium by strontium or barium serves to achieve an intended steam pressure at higher temperatures than with the use of pure calcium oxide or hydroxide. However, pure magnesium oxide/water or barium oxide/water systems are partically useless because of the unfavorable steam pressures.

The calcium oxide or hydroxide may optionally contain also other admixtures, such as silicon oxide or hydroxide and/or aluminum oxide or hydroxide.

Figure 4:
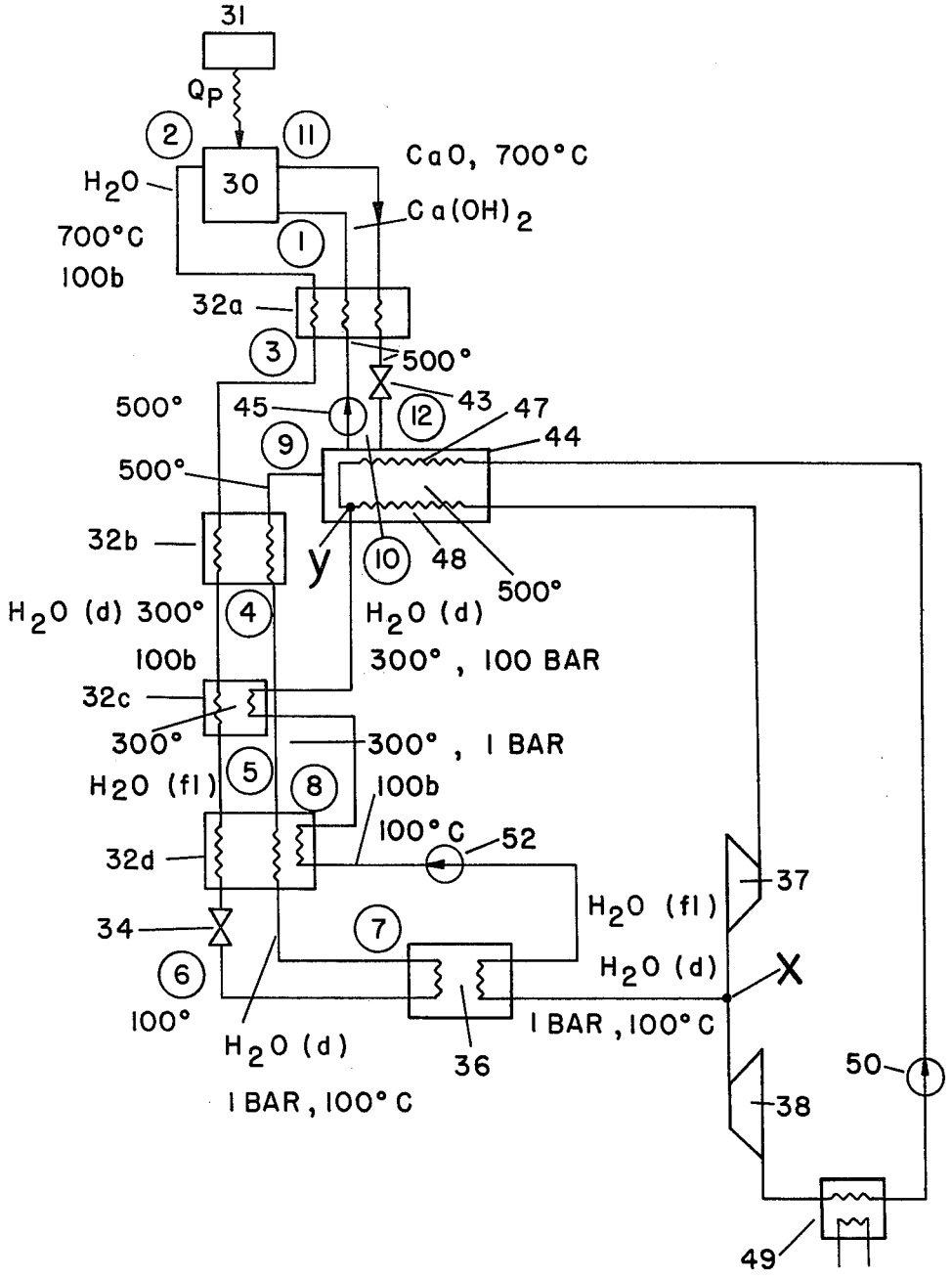
FIG. 4 is a schematic representation and illustrates a thermal power station using the principle shown in FIG. 2 by the curve drawn in solid line.

FIG. 4 is a schematic arrangement of a thermal station operating without intermediate superheating on the basis of the thermal transformation process illustrated by the solid-line curve in FIG. 2 in connection with a subsequent Clausius-Rankine process. For clarity of presentation only the parts indispensible to an understanding of the invention are shown, while the feed water heating arrangement, e.g., and other plant sections commonly encountered in conventional thermal stations have been omitted to simplify the drawing and the description. It should be noted that the thermal station, where not described hereunder, is arranged like a normal thermal station serving for the generation of, e.g., electricity.

Where it was deemed necessary the pressure and temperature of the working medium $H_2O$ is indicated at the respective lines, where (fl) indicates the liquid and (d) the vaporous or gaseous state of the working medium $H_2O$. The numerals shown in balloons correspond to the numerals at the indicated points in the diagram of FIG. 2.

In FIG. 4 and the succeeding schematic representations of power stations the arrangement vertically on the drawing of the blocks symbolizing the various station sections is a qualitative measure of the temperature at which the various station sections are operating.

The portion of the thermal station of FIG. 4 corresponding to the topping thermal transformation process contains an expulsion unit 30 directed to which is primary energy $Q_P$ from a source of heat 31, such as a firing arrangement, a nuclear power station or the like. In the expulsion unit 30 steam is expelled in accordance with curve section 1-2 at 700° C. and 100 bars from the Ca $(OH)_2$. This steam then flows successively through the heat output sides of three heat exchangers **32*a*, 32*b* and 32*c* serving for internal heat exchange. In the heat exchanger 32*a* the steam cools to 500° C. (corresponding to section 2-3 in FIG. 2); in the heat exchanger 32*b* the steam cools to 300° C. and reaches the dew curve at point 4 (FIG. 2). In the heat exchanger 32*c* the steam condenses according to section 4-5 in FIG. 2, releasing heat of condensation. The liquid $H_2O$ present at the exit of the heat output side of the third heat exchanger 32*c* then flows through the heat output side of a fourth heat exchanger 32*d*, where it is cooled to 100° C. according to point 6 in FIG. 2. The water is then expanded in its passage through a restrictor or valve 34 to a pressure of 1 bar and is directed to a vaporizer 36 where it is converted, by absorbing thermal energy from the Clausius-Rankine process, into steam of a temperature of 100° C. and a pressure of 1 bar. The steam then passes through the heat input sides of the heat exchangers 32*d* and 32*b* and is thus heated to 300° C. and 500° C., respectively, corresponding to curve section 7-9 in FIG. 2. The hot steam of 500° C. is then ducted into an absorber 44 where it is absorbed by CaO while forming $Ca(OH)_2$ and releasing heat of absorption (section 9-10 in FIG. 2). The $Ca(OH)_2$ formed in the absorber 44 is then returned in a fluidized bed and under augmented pressure by means of a pump 45 to the expulsion unit 30, when it is heated in the heat exchanger 32***a* by absorption of heat to about 700° C. The CaO produced in the expulsion unit 30 by expulsion of the steam is transferred, optionally again in a fluidized bed, while yielding heat in a second heat output section of the heat exchanger 32*a* and a pressure reducer unit 43, to the absorber 44.

The section of the thermal power plant using the principle of the Clausius-Rankine process contains a schematically represented turbine section having a first turbine 37 and a second turbine 38, a condenser 49, a feed water pump 50, an evaporizer 47 and a superheater 48. The feed water pump 50 delivers liquid water from the condenser 49 to the evaporizer 47, where the water evaporises under the heat of absorption released according to section 9-10 and where the resulting steam is heated to 500° C. in the superheater 48. The 500° C. steam then flows through the first turbine 37. The steam issuing from the first turbine 37 has a temperature, with the model here described, of 100° C. and a pressure of about 1 bar. A portion of this steam amounting e.g. to two-thirds, then flows through the second turbine at the exit of which the pressure is, e.g., about 0.05 bar. Thereafter the steam is liquefied in the condenser 49.

A second portion of, e.g., one-third of the steam issuing from the first turbine section is ducted to the heat output side of the heat exchanger 36, where it condenses while yielding heat of condensation which serves to evaporate the water in the previously described heat pump section (section 6-7). The liquid water is then pressurized to 100 bars by means of a feed pump 52, is preheated to 300° C. in a second heat input section of the heat exchanger 32*d* and is then converted into steam in the heat input section of the heat exchanger 32*c*.

The 300° C. steam is then ducted together with the steam from the vaporizer 47 to the input side of the superheater 48, closing also this partial circuit.

The Clausius-Rankine process is split into two partial circuits (between points X and Y) by means of the heat pump section of the thermal station per FIG. 4. This improves the efficiency by about 50%, e.g. from 35% when using the normal Clausius-Rankine process to an order of magnitude of about 50% when using said heat pump process and splitting the Clausius-Rankine process into two partial circuits.

Said thermal transformation process differs from the conventional thermal transformation process in that the output of effective thermal energy in the sections 4-5 and 9-10 according to FIG. 2 occurs at two different temperature levels, which because of the resulting "carnotization" achieves said notable rise in efficiency. That a thermal transformation process of said type becomes practicable by no means other than the multiple-medium system here indicated has already been mentioned elsewhere herein.

A further rise in overall efficiency of a thermal power station of the type described in light of FIG. 4 can be achieved by splitting a portion of said thermal transformation process such that it yields thermal energy to the subsequent Clausius-Rankine process at a still greater number of temperature levels, still further reducing irreversible changes in the Clausius-Rankine Process. An example of splitting a portion of the thermal transformation process into three parts is illustrated in FIG. 2 by the additional dash-line and dash-dotted curve portions.

In section 1-2-3-4-5 the thermal transformation process takes place as previously described by way of the solid-line curve of FIG. 2. However, the condensed water is now cooled to 100° C. (point 6) not in its entirety, but only a portion, e.g. a third, is reduced to a temperature of, e.g., 160° C. only and is expanded to a corresponding pressure, which reflects point 6'. The 160° C. water is then vaporized (section 6'-7') by picking up heat from the Clausius-Rankine process, which will still be described in more detail in the light of FIG. 5. The steam is then heated up to point 9', which corresponds to a temperature of 560° C., and at this temperature the steam is then absorbed by a portion of the CaO, where thermal energy $Q_{b60}$ is released and can be used in the Clausius-Rankine process for superheating steam.

In a similar manner a further portion of, e.g., a second one-third of the condensed water can be cooled to a point 6'' which corresponds to, e.g., a temperature of 50° C., the cooled water can then be evaporated in accordance with section 6''-7'', which will yield steam under a pressure of about 0.1 bar, the steam can then be heated up to point 9'', which corresponds to a temperature of 440° C., and it can then be allowed to be absorbed at this temperature by a further portion of the CaO, where absorption energy $Q_{440}$ is released at a temperature of 440° C. (section 9''-10'').

A third portion of the condensed water of, e.g., the third one-third, is subjected to continued treatment in accordance with the process described by the solid-line curve.

The fact that thermal energy can now be admitted to the Clausius-Rankine process at the three different temperatures of 560° C., 500° C. and 440° C., makes the changes of state reversible to a still greater degree and correspondingly raises the efficiency of the thermal stations as a whole.

Figure 5:
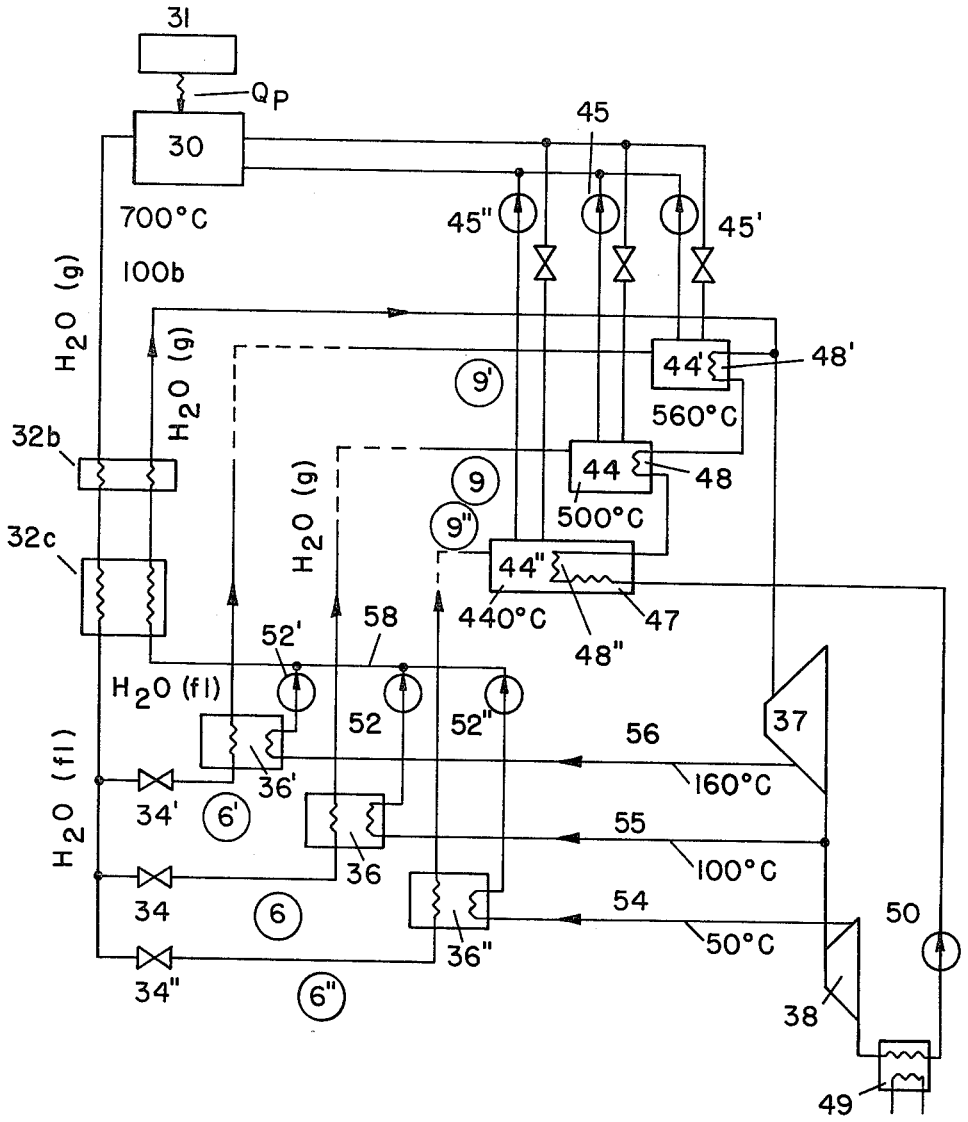
FIG. 5 is a simplified schematic representation corresponding to FIG. 4 of a thermal power station using the principle of the three partial process illustrated in FIG. 4.

FIG. 5 schematically illustrates a thermal station operating on the basis of said split thermal transformation process. The representation corresponds to FIG. 4; a portion of the heat exchanger serving for internal heat exchange has been omitted, however, for clarity of presentation. It should be noted, through, that the measures for internal heat exchange described in light of FIG. 4 can be used also with the thermal power station in accordance with FIG. 5.

FIGS. 4 and 5 use the same reference numerals for corresponding power station sections. Additional station sections of the power plant per FIG. 5 added by splitting the thermal transformation process and corresponding in function to station sections of the thermal power station per FIG. 4, have been identified by an additional stroke or by two additional strokes and they operate in correspondence with the sections of the process per FIG. 2 indicated by numerals having one or two strokes.

The thermal station per FIG. 5 again comprises one (or several) expulsion unit 30 to which primary thermal energy $Q_p$ is admitted from a source of heat 31. The liquid water of 300° C. and 100 bars available at the exit of the heat output side of the heat exchanger 32*c* is now expanded in its passage through three valves 34, 34' and 34'' to conditions corresponding to points 6, 6' and 6'', respectively. The water is then vaporized in the vaporizers 36, 36' and 36'', respectively, with thermal energy picked up from the Clausius-Rankine process, the steam is then heated by internal heat exchange (omitted in FIG. 5), and the separate partial steam flows are then absorbed in corresponding absorbers 44, 44' and 44'' at the stated temperatures. The thermal energy of absorption released in the process, $Q_{440}$, $Q_{500}$ and $Q_{560}$, is used for evaporating the feed water in vaporizer 47 and superheating the resulting steam in three successively connected superheaters 48'', 48, 48''. The developing steam then pressurizes the first portion 37 of the turbine section.

From the section of the thermal station per FIG. 5 using the Clausius-Rankine process, or more precisely from the turbine section, partial steam flows are diverted through lines 54, 55 and 56 at temperatures of about 50° C., 100° C. and 160° C., respectively, to supply the thermal input energy for the vaporizers 36'', 36 and 36', respectively. The resulting condensed water is pressurized to 100 bars by means of feed pumps 52, 52' and 52'', respectively, and ducted to a common line 58 connecting to the heat input side of the heat exchanger 32*c*, in which the water evaporates. The steam is then heated as in the thermal station per FIG. 4 to the assumed turbine inlet temperature of 560° C., and after joining the steam from the superheater 48' it is then ducted to the entry of the turbine section 37-38.

FIG. 6 shows the diagram of a work-producing topping process of the type indicated by Koenemann (l.c.), where use is made, however, of said multiple-medium system $CaO/H_2O$. It is again assumed that the work output, i.e. turbine operation, begins at 560° C. As previously illustrated in light of FIG. 2 the primary heat can be admitted at 700° C., owing to the vapor pressure curve of Ca $(OH)_2$, without causing the pressure to exceed 100 bars.

The various curve sections reflect the following process steps:

1-2: Expulsion of $H_2O$ steam at 700° C. and p=100 bars while admitting about 5200 kJ enthalpy per 1 kg $H_2O$ steam. The steam may have to be cleaned from any CaO dust it may be carrying.

2-3: Cooling the steam by isobar process under internal heat exchange (in counterflow to the saturated Ca $(OH)_2$ in section 6-1 to be heated to expulsion temperature) to t=560° C. This internal heat exchange makes the process largely reversible, i.e. carnotized, between 700° C. and 560° C., so that the effective upper temperature at which the primary heat is effective remains at about 700° C.

3-4: Expanding the steam in a turbine to T=120° C. and p=2 bars; FIG. 6 assumes a turbine efficiency of 0.85 for section 3-4.

4-5: Heating the steam by isobar process to 530° C. (p=2 bars). This can possibly be achieved by heat exchange with the succeeding Clausius-Rankine process or by flue gases.

5-6: Absorption of the steam at 520° C. while releasing about 5200 kJ enthalpy per 1 kg steam absorbed. This amount of heat is used for generating steam and superheating the working medium ($H_2O$) in the succeeding Clausius-Rankine process.

6-1: Heating the $Ca(OH)_2$ to the expulsion temperature of 700° C. in counterflow with steam to be cooled (section 2-3) and CaO to be cooled (schematically represented section 7-8), which will be re-used for absorption.

Said work-producing topping process is made practicable by no means other than the novel multiple-medium system $CaO/H_2O$ (and by the metal-hydrogen medium systems still to be described). The overall efficiency of the thermal station is considerable increased by this preliminary process in that $H_2O$ steam of a given pressure can be generated at substantially higher temperatures than in a classical thermal station, where the medium evaporated is essentially straight water) and in that the heat transfer from the generating temperature of the steam (700° C. for the model described) to the maximum allowable turbine inlet temperature (560° C. with the model described) takes places in virtually the absence of irreversible changes in state. The work gained in section 3-4 is obtained additionally to that derived from the succeeding Clausius-Rankine process.

Figure 7:
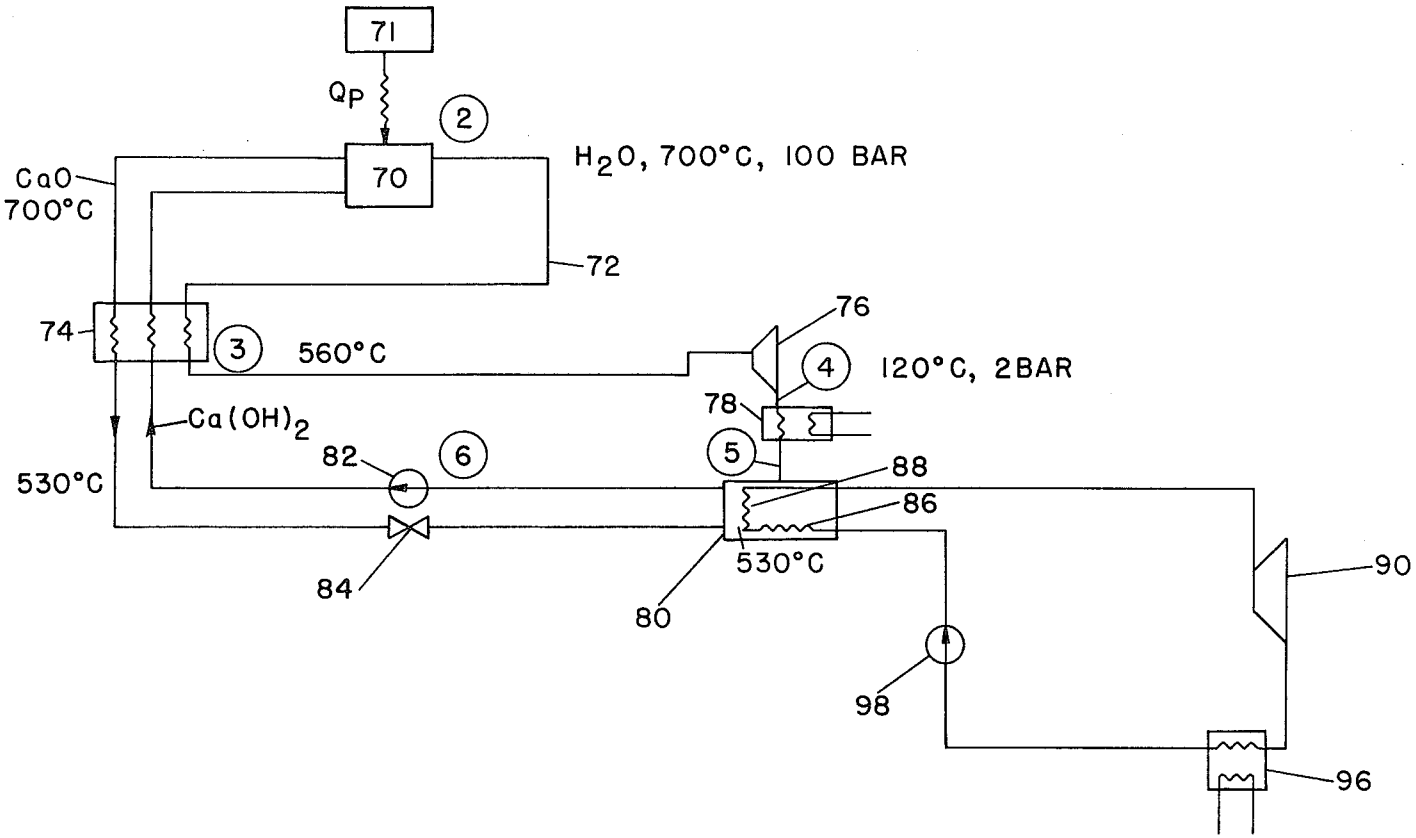
FIG. 7 is a schematic representation of a thermal power station using the principle of the process according to the curve drawn in solid line in FIG. 6.

FIG. 7 schematically illustrates the essential sections of a thermal power station operating on the basis of said process in accordance with the solid-line curve in FIG. 6. The power station comprises an expulsion unit 70 in which $H_2O$ steam is expelled at a pressure of 100 bars and a temperature of 700° C. from the CA $(OH)_2$(section 1-2 of the diagram per FIG. 6) by means of primary heat $Q_p$ from a primary heat source 71. The steam is then ducted, through a line 72, to the heat output portion of a heat exchanger 74 in which the temperature of the steam is reduced to 560° C. corresponding to section 2-3 of FIG. 6. The steam then passes through a first turbine 76, from which it issues at a temperature of 120° C. and a pressure of 2 bars. This steam is then heated in isobar process in a heat exchanger 78 to, e.g., 530° C. (point 5 in FIG. 6) and thereafter ducted to an absorber 80, where it is absorbed by CaO while generating absorption heat (section 5-6 in FIG. 6). The resulting Ca $(OH)_2$ is returned to the expulsion unit 70 via a fluidized bed transportation system which contains a pump 82 raising the pressure of the fluidized bed to 100 bars, through the heat exchanger 74 raising the temperature of the calcium hydroxide to about 700° C., in which expulsion unit steam is again expelled. The CaO remaining after the expulsion of the steam is returned to the absorber by means of a fluidized bed system through the heat exchanger 74, in which the pressure is reduced to the 2-bar absorber pressure. This closes the circulating system of the topping process.

The section of the thermal station using the Clausius-Rankine process contains a turbine 90 energised by the steam generated in the vaporizer 86 by the heat released in the absorber 80 and superheated in the superheater 88 to 530° C.

After the steam has passed through the turbine 90 it is condensed conventionally in a condensor 96 and the condensed water is then likewise routed to the inlet side of the vaporizer 86 via a main feed pump 98. The thermal energy required for superheating the steam in section 4-5 (FIG. 6) can be obtained, e.g., from flue gases, divertion of steam from the Clausius-Rankine process, or in any other suitable manner.

Also when the work-producing topping process described above in light of FIGS. 6 and 7 is used the efficiency can still be raised by splitting this topping process into several partial processes for maximum carnotization of the subsequent Clausius-Rankine process.

In the topping process per FIG. 6 this can be achieved, e.g., by expanding (exhausting) partial amounts of the steam present at point 3 in several turbines or a multiple-stage turbine having tapping points while doing work to several different temperature and pressure levels. A portion of the steam can be exhausted, e.g., to a point 4' corresponding to a temperature of about 190° C. and a pressure of 5 bars, and a further portion to a point 4″ corresponding to a temperature of 50° C. and a pressure of about 0.1 bar, and the steam exhausted to point 4 (120° C., 2 bars) can be superheated to a point 4a and then be exhausted in a turbine (section 4a-4″). A further portion of the steam is exhausted from point 3 to point 4 as described above.

The exhausted steam is then heated each time by isobar process, where one comes from point 4′ to point 5′ (560° C., 5 bars) and from point 4″ to point 5″ (440° C., 0.1 bars). At these temperatures and pressures the steam is then absorbed by CaO in separate absorbers, where heat of absorption is released at the respective temperature levels. The thermal energy released at the three temperature levels of 440° C., 520° C. and 560° C. can then be routed to suitable points of a steam generator, superheating or intermediate superheating section (e.g. sections B-C, C-D or E-F in FIG. 1) of the power station portion using the Clausius-Rankine process. Owing to the fact that the thermal energy of absorption is essentially generated at the temperature level at which it is needed in the Clausius-Rankine process, irreversible processes are considerably reduced and the efficiency is raised accordingly.

It should be noted at this point that transportation of the powdery solids CaO and $Ca(OH)_2$ can also be discontinuous rather than by continuous fluized bed process in that two (or three) reaction vessels are connected alternately as expulsion units and absorbers.

The efficiency of a split work-producing topping process of said type amounts ideally to about 70%, and in practical applications efficiencies over 50% will be achieved without undue complexity of design, since the essential losses remaining apart from the turbine and heating losses are merely losses by heat exchanging processes and by hysteresis effects in the absorption and expulsion processes varying with the rate at which the process is implemented.

Figure 8:
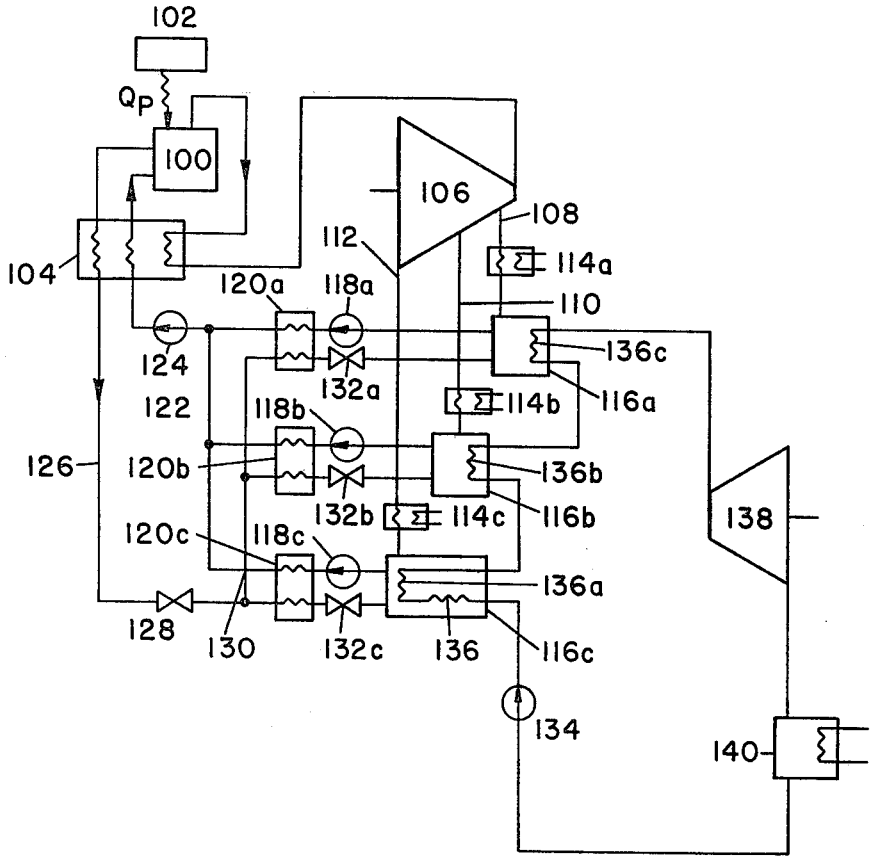
FIG. 8 is a simplified schematic representation of a thermal power plant using the principle of the split topping process illustrated by way of FIG. 6.

Illustrated schematically in FIG. 8 are the essential portions of a thermal power station to implement the split topping process just described in light of FIG. 6. Steam is expelled at a temperature of 700° C. and a pressure of 100 bars from $Ca(OH)_2$ in an expulsion unit 100 corresponding to the expulsion unit 30 in FIGS. 4 and 5 obtaining primary thermal energy $Q_p$ from a heat source 102 (section 1-2 in FIG. 6). The resulting steam flows through the heat output side of a heat exchanger 104 and is cooled in isobar process to 560° C., which is the inlet temperature of a multiple-state preliminary turbine 106. From the turbine 106 three partial flows are diverted, through lines 108, 110 and 112, which are exhausted to three different temperature and pressure values (intermediate superheating per section 4-4a in FIG. 6 is omitted in FIG. 8).

The lines 108, 110 and 112 lead, through heat exchangers 114a, 114b and 114c in which the exhausted steam is heated by isobar process to temperatures corresponding to points 5′, 5 or 5″ (FIG. 6), to the absorbers 116a, 116b and 116c, where the heated steam is absorbed by CaO according to curve sections 5′-6′,5-6, or 5″-6″. The Ca $(OH)_2$ produced in the absorbers is routed to a joint line 112 through pressure raising means 118a, 118b, or 118c and heat exchangers 120a, 120b or 120c, by which joint line 122 is returned to the expulsion unit 100 if necessary through a further pressure-raising means 124 and the heat exchanger 104. The CaO produced in the expulsion unit 100 is routed, through a line 126 leading through the heat exchanger 104, and through a first pressure-reducing means 128, to a manifold 130 and from there to the absorbers 116a, 116b or 116c through the heat exchangers 120a, 120b and 120c and further separate pressure-reducing means 132a, 132b or 132c.

The portion of the thermal power station of FIG. 8 using the Clausius-Rankine process contains a feed water pump 134 delivering water to a vaporiser 136 heated by the heat of absorption released in the absorber 116c. The resulting steam flows sucessively through three superheaters 136a, 136b and 136c heated by the thermal energy of absorption generated in the absorbers 116c, 116b or 116a. The superheated steam is routed from the last superheater 136c to a turbine 138 the exit of which connects to a condenser 140 in which the exhausted steam is condensed. The condensate is then delivered by the feed water pump 134 back to the vaporizer 136. The absorbers 116a, 116b and 116c can work at the temperatures of, e.g., 560° C. 500° C. and 440° C. The heat exchangers 114a, 114b and 114c can be supplied with heat from, e.g., flue gases of a firing arrangement.

A further multiple-medium system in accordance with the present invention for advantageous implementation of the topping processes described in light of FIGS. 2 and 6 is a metal-hydrogen system operating on the basis of the following equations:

$$M_2H_Y + Q_2 \underset{T_4}{\overset{T_1}{\rightleftharpoons}} M_2 + \frac{Y}{2} H_2 \tag{2}$$

$$\frac{x}{2} H_2 + M_1 \underset{T_3}{\overset{T_2}{\rightleftharpoons}} M_1H_x + Q_1 \tag{3}$$

where $M_1$ and $M_2$ stand for metals. The term "metal" is here understood in its widest sense and includes pure or technically pure metallic chemical elements as well as alloys, intermetallic compounds and the like.

The equation (2) corresponds to decomposition or desorption and is equivalent to evaporization, where $Q_2$ is the volume of heat to be expended for the continuation of the equation to the right-hand side.

The equation (3) corresponds to reaction or absorption and is equivalent to condensation, where $Q_1$ constitutes the heat released in continuation of the equation to the right-hand side.

Metal-hydrogen systems provide an advantage in that with adequately fine distribution of the metals, rapid attainment of the solid-gas equilibriums is ensured, so that only relatively small amounts of material and small reaction vessels are required for the reactions.

A further advantage is provided in that the vapor or gas pressures prevailing at a given temperature in equilibrium with the metal can be adapted to suit an intended process by selecting an alloy of suitable composition.

Suitable metals would be, e.g., circonium, titanium, hafnium, vanadium, niobium, tantalum, rare earth metals, uranium, thorium and alloys of these metals among themselves and with other metals, such as ZrV, ZrCr, ZrCo, TiNi, TiV, ThNi, ThCo and ThFe. Use can also be made of alkaline metals or alkaline earth metals alone or in alloys, such as Li, Na, LiAl, $Mg_2Ni$ and several others.

Figure 9:
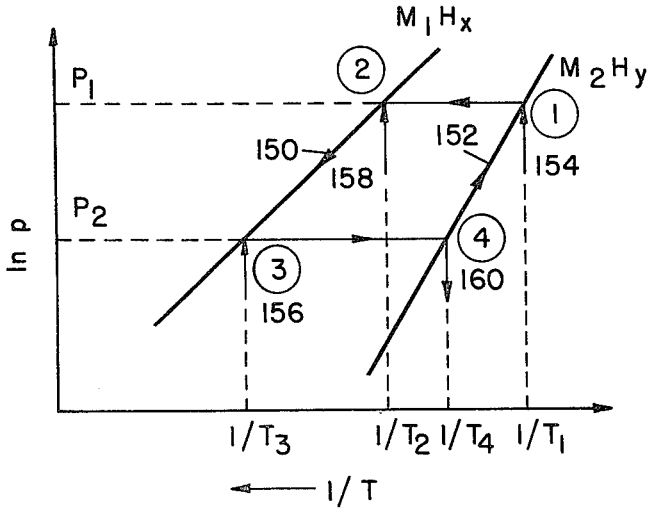
FIG. 9 is a diagram and illustrates a simple metal-hydrogen system in accordance with the present invention, where plotted along the ordinate are the natural logarithm of hydrogen pressure and along the abscissa the negative reciproval of absolute temperature.

The principle of a metal-hydrogen system is described in light of the diagram of FIG. 9 in that the negative reciprocal of temperature is plotted along the abscissa (so that rising temperatures correspond to progress to the right-hand side) and the natural logarithm of hydrogen pressure p along the ordinate. The straight lines 150, 152 indicate the hydrogen pressure p prevailing in equilibrium at a certain temperature relative to a metal $M_1$ or $M_2$, thus corresponding to the vapor pressure curves of a liquid-steam system.

Point (1) indicates the presence of the metal-hydrogen compound $M_2H_y$ from which, by the admission of thermal energy (arrowhead 154) at a relatively high temperature $T_1$ and a relatively high pressure $p_1$, hydrogen is expelled. The hydrogen is absorbed ("resorbed") at point (2) at the same pressure $p_1$ but at a lower temperature $T_2$ by a metal $M_1$ and the metal-hydrogen compound $M_1H_x$ is formed. At a correspondingly low pressure $p_2$ the hydrogen is again released at point (3) (despite the still low temperature $T_3$), with a volume of heat (arrowhead 156) being admitted at the temperature $T_3$. The again released hydrogen is then again bound to the metal $M_2$ at a temperature $T_4$ running below $T_1$, where again the compound $M_2H_x$ is formed. The hydrogen can now be expelled by admitting the thermal energy 154 at the temperature $T_1$.

In the absorption processes according to points (2) and (4) heat of absorption is released according to arrowheads 158 or 160 at the temperature $T_2$ or $T_4$.

Figure 10:
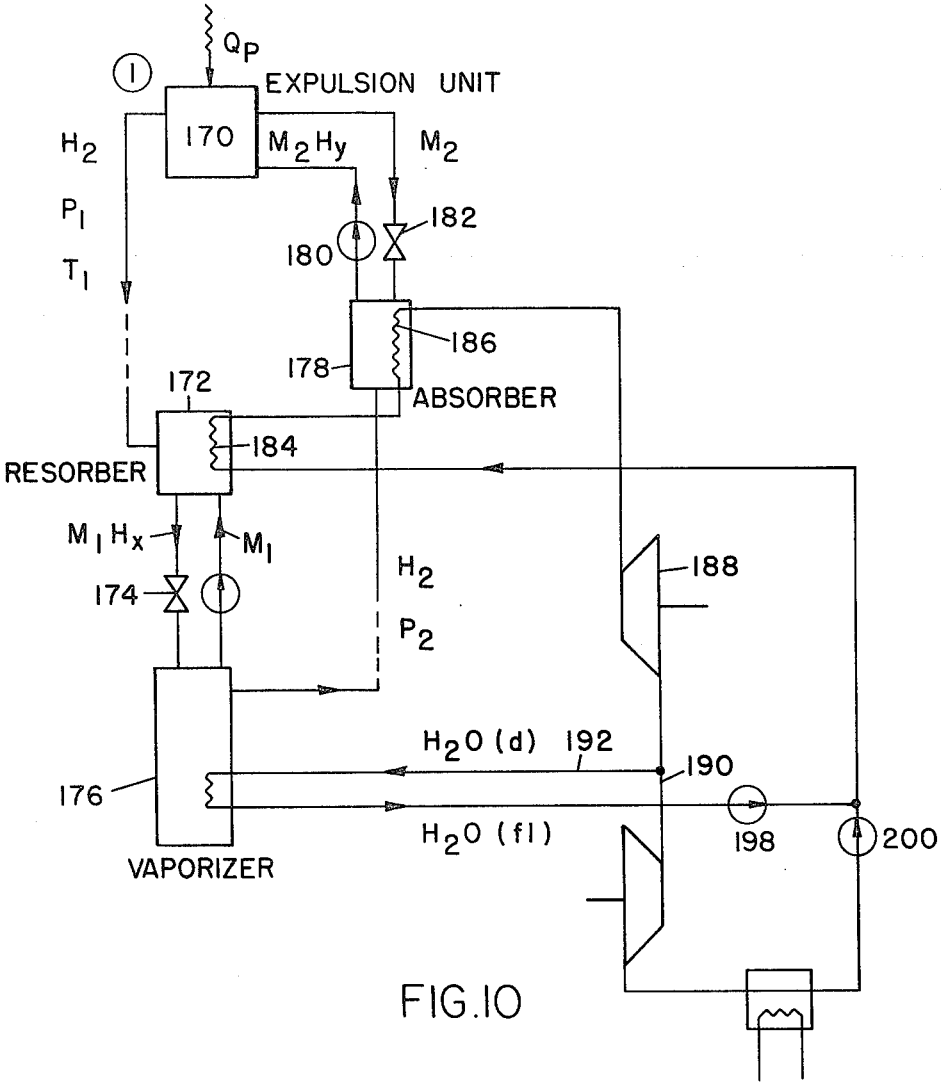
FIG. 10 is a schematic representation of the implementation of a non-working-producing topping process using a metal-hydrogen system of the type illustrated by way of FIG. 9 in a thermal power station of the type illustrated by FIG. 4, and FIGS. 11 and 12 are representations corresponding to FIG. 9 or 10 to illustrate a split topping process.

FIG. 10 shows the schematic arrangement of a thermal power station in which similarly to the thermal station of FIG. 4 a single topping process is provided which does no external work and which operates on a metal-hydrogen system. Inasmuch as condensation of the gaseous working fluid $H_2$ is prevented, condensation must be replaced by a second absorption ("resorption") of the hydrogen by another metal at another temperature than that at the release of the hydrogen, as has been described in light of FIG. 9.

In an expulsion unit 170 hydrogen H2 is expelled from a metal-hydrogen compound $M_2H_y$ by the admission of primary heat $Q_p$ at a temperature $T_1$ (FIG. 9) and a pressure $p_1$.

After cooling to a temperature $T_2$ in a heat exchanger omitted on the drawing but corresponding to the heat exchanger 32*a* in FIG. 4 the hydrogen is then carried to a resorber 172 containing the metal $M_1$. Here the compound $M_1H_x$ is formed under the release of binding energy 158 (FIG. 9), which is carried to a vaporizer 176 via a pressure-reducing means 174 and a heat exchanger omitted on the drawing. In the vaporizer 176 the hydrogen is again released in accordance with point 3 in FIG. 9 by the admission of heat. The released hydrogen is then carried to an absorber 178 where it is absorbed at the temperature T by metal $M_2$ in accordance with point (4) of the diagram of FIG. 9 while thermal energy (arrowhead 160) is released. The resulting $M_2H_y$ is returned to the expulsion unit 170 through a pressure-raising means 180. From the expulsion unit 170 the metal $M_2$, now free from hydrogen, is carried to the absorber 178 through a pressure-reducing means 182.

The thermal energy released in the resorber in accordance with point 2 of the diagram of FIG. 9 is used in a vaporizer 184 for vaporizing feed water. The resulting steam is heated further in a superheater by the heat released in the absorber 178 at the temperature $T_4$ and the resulting superheated steam is carried to a first section 188 of a turbine system of the power station. Connected to the output end of the turbine system section 188 are two lines 190,192. The line 190 leads to a second section of the turbine system, the exit of which is connected to a condenser 196. The line 192 leads to a heating coil 197 in the vaporizer 176, where the steam is condensed at the temperature $T_3$ while yielding heat in accordance with arrowhead 156. The resulting liquid $H_2O$ is carried to the vaporizer 184 through a first feed pump and the condensed water from the condenser 196 is carried to the vaporizer 184 through a second feed pump 200.

In order to prevent losses the practice will be also with the thermal power station of FIG. 10 to provide heat exchangers as it has been described in light of FIG. 4.

The topping process described in light of FIGS. 9 and 10 can be split similarly as described in light of FIG. 2 such that thermal energy is admitted to the subsequent Clausius-Rankine process at still more temperature levels in order to carnotize the process.

The topping process described in light of FIGS. 9 and 10 can be split into three partial circuits between, e.g., the resorber 172 and the absorber 178. When the topping process is split, a special advantage of the metal-hydrogen system will come to bear, namely, that when suitable metals, especially alloys, are selected, the resorbers of all partial circuits can be operated at the same pressure, and the vaporizers of all partial circuits at the same temperature. (This, however, is not a definite requirement). One will have to work at different temperatures or pressures if use is made of the same metal ($M_1$) in all partial circuits.

Figure 12:
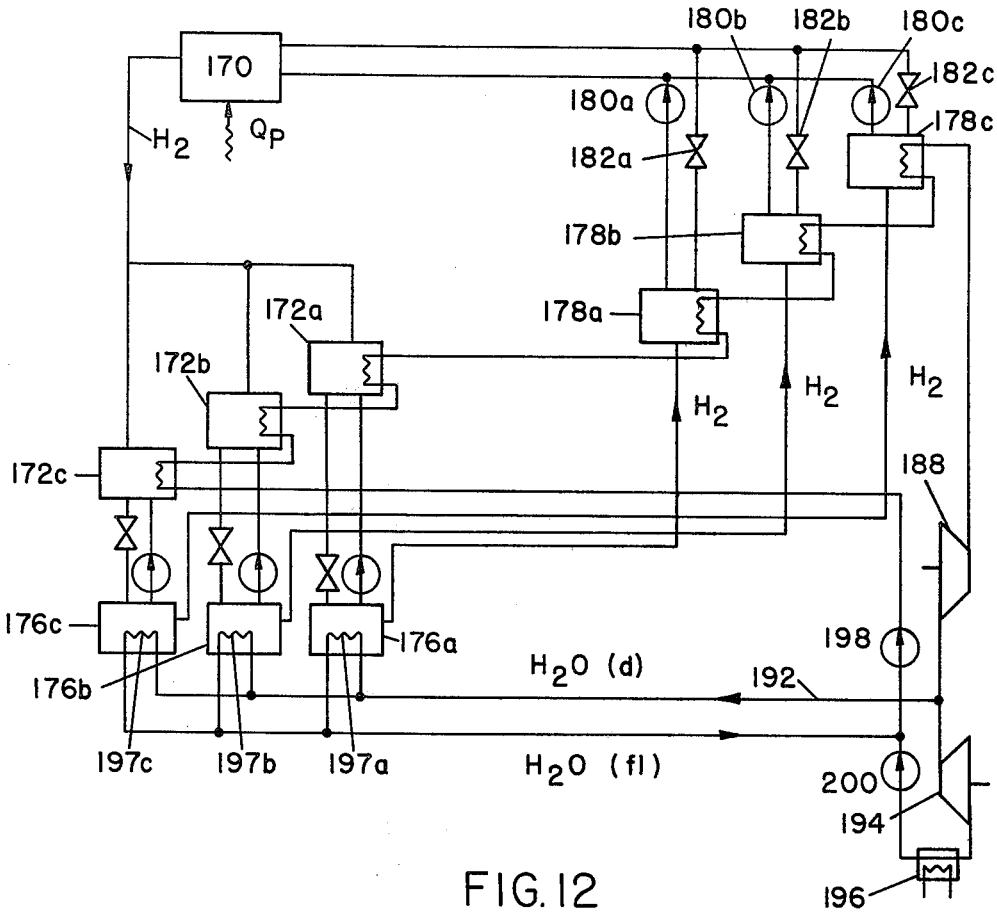
Figure 11:
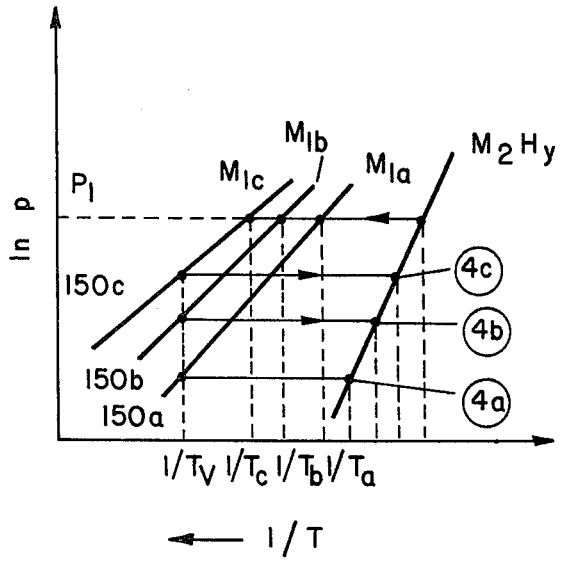

In FIGS. 11 and 12 it is assumed that the topping process described in light of FIGS. 9 and 10 is to be split into three partial processes. In lieu of the single resorber 172, therefore, three resorbers 172*a*, 172*b* and 172*c* are required, to which the hydrogen released in the expulsion unit 170 is carried. The resorbers operate at three different temperatures $T_a$, $T_b$ or $T_c$ (FIG. 11) but at the same pressure $p_1$, and they contain metals $M_{1a}$, $M_{1b}$ and $M_{1c}$ selected such that they will produce the "vapor pressure curves" 150*a*, 150*b*, or 150*c*. The resorbers 172*a*, 172*b* and 172*c* are associated with vaporizers 176*a*, 176*b* and 176*c* all operating at the same temperature $T_v$. The hydrogen released in the vaporizers 176*a*, 176*b* and 176*c* is carried to three absorbers 178*a*, 178*b* and 178*c* operating at the temperatures and pressures in accordance with points (4*a*), (4*b*) or (4*c*) of FIG. 11 and corresponding to the absorber 178 in FIG. 10. For the remaining components of the thermal power station of FIG. 12, use was made of the same or corresponding reference numerals and symbols as in FIG. 10, so that further description is obviated.

The metal-hydrogen systems can naturally be used also for implementing work-producing topping processes of the type described above in light of FIGS. 6 to 8, where only a single metal is required.

Transportation of the generally powdery metals or metal-hydrogen compounds can again be achieved by a fluidized bed process. An alternative approach would naturally be batch operation, where several reaction vessels are provided to operate alternately as expulsion units and absorbers or vaporizers and resorbers. In this case, three each reaction vessels will generally be provided for a circuit or partial circuit, so that two of these may be operating while the third one is allowed to cool.

Nuclear power plants of the present state of the art exhibit, e.g., a relatively poor efficiency in that a nuclear reactor cannot be used, for various reasons, to generate superheated steam. Using the above-described working medium systems and processes of the heat pump type, the steam power plant, which obtains its thermal energy primarily from the nuclear power plant, can be connected to a heat pump process of the type described in light of FIGS. 2 to 5 or 9 to 12 which obtains the necessary high-temperature energy from fossil fuel and supplies thermal energy for superheating or intermediate superheating the steam generated by the nuclear power station.

Should the resulting complexity of design be warranted economically, use can be made in one and the same thermal station of a topping heat pump process as well as a work-producing topping process of the type described.

What is claimed is:

1. A thermodynamic process for raising the efficiency of a thermal power station containing a main section operating on the principle of the Clausius-Rankine process and doing work as well as an additional section operating on the principle of a heat pump, in which the multiple-substance working medium is decomposed by primary heat at a temperature in a first high-temperature range by this high-temperature thermal energy into a condensed (solid or liquid) first component and a gaseous second component and the resulting gaseous component is transformed into a condensed state, is then returned to the gaseous state and finally again united with the condensed component of the multiple-substance working medium, characterized in that the multiple-substance working medium comprises combinations of $CaO/H_2O$ and metal/hydrogen, where the term metal includes metallic chemical elements and alloys which combine with hydrogen under positive heat of reaction, and that condensation occurs at a temperature in a second temperature range below the first high-temperature range, in that transfer into the gaseous state occurs at a temperature in a third temperature range below the second temperature range, and in that union occurs at a temperature in a fourth temperature range lying between the first and the third temperature ranges but differing from the second temperature range, and in that the amounts of thermal energy released during condensation and union are admitted to the Clausius-Rankine process at essentially the temperature in the second and fourth temperature ranges.

2. Method of claim 1, characterized in that the multiple-substance working medium is decomposed at a temperature of at least 300° C.

3. Method of claim 1 or 2, characterized in that the metal contains at least one chemical element, such as Li and Na, which forms a hydride.

4. Method of claim 3, characterized in that the metal contains at least one additional alloying component, such as Al.

5. Method of claim 1 or 2, characterized in that the metal contains at least one of the elements circonium, titanium, hafnium, vanadium, niobium, tantalum, uranium and thorium and/or rare earth metals.

6. Method of claim 5, characterized in that the metal contains additionally at least one of the elements nickel, cobalt, chromium and vanadium.

7. Method of claim 1, characterized in that the thermal energy required to transfer the second component of the multiple-substance working medium into the gaseous state is taken from the Clausius-Rankine process.

8. Method of claim 1 or 7, characterized in that the multiple-substance working medium is a metal-hydrogen system and in that the condensation is effected by resorbing the hydrogen in a second metal and transfer into the gaseous state is effected by expelling the hydrogen from this second metal.

9. Method of one of the claims 1 or 7 characterized in that the gaseous second component released by the high-temperature thermal energy condenses at several different temperatures in the second temperature range and unites again with the condensed first component at several different temperatures in the fourth temperature range, and in that the amounts of thermal energy released at the various condensation temperatures as well as the amounts of thermal energy released at the various union temperatures are admitted to the Clausius-Rankine process essentially at points where thermal energy is required at these temperatures.

10. Method of claim 1 for raising the efficiency of a power station containing a main section operating on the Clausius-Rankine process and doing external work as well as a topping section in which a multiple-substance working medium is decomposed by the admission of primary thermal energy in a high 1st temperature range into a condensed (liquid or solid) first component and into a gaseous 2nd component and the gaseous 2nd component is expanded in a turbine system and then again united with the first component, characterized in that the gaseous second component issuing from the turbine system is heated with thermal energy from the Clausius-Rankine process to a temperature in a second temperature range which lies below the first temperature range, and in that the heated second component is united with the first component at a temperature in a second temperature range which lies below the first temperature range, and in that the thermal energy released in the union is admitted to the Clausius-Rankine process.

11. Method of claim 10, characterized in that the gaseous second component is expanded in the turbine system to several different pressures and is united with a corresponding number of partial quantities of the first component at the temperatures corresponding to these pressures, where the amounts of thermal energy released at the various temperatures are admitted to the Clausius-Rankine process at places where these temperatures are needed.

12. Method of claim 10 or 11, characterized in that the first, high temperature range lies above a maximum allowable inlet temperature of the turbine system and in that the gaseous second component released by the primary thermal energy at the temperature in the first high temperature range is cooled by heat exchange to a temperature which is at most equal to the maximum allowable inlet temperature of the turbine system.

13. Thermal power station for implementing a process for raising the efficiency of a thermal power station containing a main section operating on the principle of the Clausius-Rankine process and doing work as well as an additional section operating on the principle of a heat pump, in which the multiple-substance working medium is decomposed by primary heat at a temperature in a first high-temperature range and the resulting gaseous component is transformed into a condensed state, is then returned to the gaseous state and finally again united with the condensed component of the multiple-substance working medium, and wherein condensation occurs at a temperature in a second temperature range below the first high-temperature range, the transfer into the gaseous state occurs at a temperature in a third temperature range below the second temperature range, union occurs at a temperature in a fourth temperature range lying between the first and the third temperature ranges but differing from the second temperature range, and the amounts of thermal energy released during condensation and union are admitted to the Clausius-Rankine process at essentially the temperature in the second and fourth temperature ranges, said power station comprising a main section operating on $H_2O$ as a working medium and containing a main working medium circuit comprising in this order a main feed pump, an evaporizer, a live-steam superheater, a multiple-stage turbine system having a live-steam inlet and a dead-steam outlet and being energized with superheated live steam, and a condenser which connects to the dead-steam outlet and communicates with the inlet of the main feed pump, characterized in that the main section further exhibits at least one auxiliary working medium circuit with a branch line for diverting a partial amount of the medium, the beginning of which communicates with a point (x in FIG. 4) of the turbine system (37, 38) arranged between the live-steam inlet and the dead-steam outlet, which contains in this order an auxiliary condenser (36), an auxiliary feed water pump (52) and an auxiliary vaporizer (32*c*) and connects at its end to a point (Y) of the main circuit arranged ahead of the live-steam inlet of the turbine system (37, 38), and in that the additional section operating on the multiple-substance working medium contains an expulsion unit (30) in which the multiple-substance working medium is decomposed by high-temperature primary heat ($Q_P$) at a temperature (e.g. 700° C.) lying in the first temperature range into the two components, further a condenser (32*c*) in which the second component expelled at a given pressure (e.g. 100 bars) in the explusion unit (30) is liquefied by essentially isobar process at a temperature (300° C.) lying in the second temperature range and yields the resulting heat of condensation to the auxiliary vaporizer (R/H side of 32*c*), an expansion means (34) for expanding the liquefied second component to a lower second pressure (e.g. 1 bar), a vaporizer (36) in which the expanded liquid second component is again brought to the gaseous state at a temperature (e.g. 100° C.) lying in a third temperature range by the heat of condensation from the auxiliary condenser, an absorber (44) in which the gaseous second component from the vaporizer (36) is again united with the first component of the multiple-substance working medium, and means for transferring the first component of the multiple-substance working medium from the expulsion unit (30) to the absorber (44) and for transferring united multiple-substance medium from the absorber to the expulsion unit.

14. Thermal power station of claim 13, characterized in that connected to several points of the turbine system (37, 38) carrying working medium of various temperatures are several branch lines (54, 55, 56) assigned to each of which is a vaporizer (36, 36', 36'') and an absorber (44, 44', 44''), where the vaporizers and the absorbers each operate at different temperatures (FIG. 5).

15. Thermal power station of claim 13 or 14, characterized by heat exchangers (32*a*, 32*b*, 32*d*) serving for internal heat exchange.

16. Thermal power station for implementing the process of claim 13 or 14, characterized in that when use is made of a metal-hydrogen system as a multiple-substance working medium, the place of each condenser is taken by a resorber (172, 172*a*, 172*b*, 172*c*) which together with the associated vaporizer (176, 176*a*, 176*b*, 176*c*) of the additional section form an auxiliary multiple-substance working medium circuit, where in the various multiple-substance working medium circuits use is made of different metals (FIGS. 10 and 11).

17. Thermal power station for implementing the process for raising the efficiency of a power station containing a main section operating on the Clausius-Rankine process and doing external work as well as a preliminary section in which a multiple-substance working medium is decomposed by the admission of primary thermal energy in a high first temperature range into a condensed (liquid or solid) first component and into a gaseous second component and the gaseous second component is expanded in a turbine system and then again united with the first component, and in which the gaseous second component issuing from the turbine system is heated with thermal energy from the Clausius-Rankine process to a temperature in a second temperature range which lies below the first temperature range, and the heated second component is united with the first component at a temperature in a second temperature range which lies below the first temperature range, and the thermal energy released in the union is admitted to the Clausius-Rankine process, said thermal power station having a main section operating on $H_2O$ as a working medium and containing a main working medium circuit comprising in this order a main feed pump, a vaporizer, a live-steam superheater, a multiple-stage turbine system energized with superheated live steam and having a live-steam inlet and a dead-steam outlet, and a condenser connected to the dead-steam outlet and communicating with the inlet of the main feed pump, and having an additional section containing an expulsion unit in which the multiple-substance working medium is decomposed into two components by primary heat at a high-temperature lying in a first temperature range, a turbine system energized with the gaseous second component released in the process at a given pressure, and an absorber connected to the exit of the turbine system in which the exhausted second component is again united with the first component, characterized in that a heat exchanger (78) intervenes between the exit of the turbine system (76) energized with the expelled second component and the absorber (80), in which the exhausted second component is heated with thermal energy taken from the main section, and in that the absorber (80) contains means (86, 88) for routing the heat of absorption released in its interior to the working medium of the main section.

18. Thermal power station of claim 17, characterized in that the additional section contains several absorbers to which the gaseous second component is ducted at various temperatures from various points of the turbine system (106) of the additional section.

19. Thermal power station of claim 18, characterized in that when use is made of a metal-hydrogen system the place of each absorber is taken by a resorber, and that each resorber is associated with an auxiliary vaporizer and that the resorber/auxiliary vaporiser systems operate on metal/hydrogen multiple-substance working media containing different first components.

20. Thermal power station of claims 17 or 18 or 19, characterized by heat exchangers (104, 114, 120) serving for internal heat exchange.

* * * * *